US006641351B2

(12) United States Patent
Payne

(10) Patent No.: US 6,641,351 B2
(45) Date of Patent: Nov. 4, 2003

(54) PARKING GARAGE ELEVATOR SYSTEM

(76) Inventor: William S. Payne, 195 E. 800 South, Springville, UT (US) 84663

( * ) Notice: Subject to any disclaimer, the term of this patent is extended or adjusted under 35 U.S.C. 154(b) by 0 days.

(21) Appl. No.: 09/847,938

(22) Filed: May 2, 2001

(65) Prior Publication Data

US 2002/0164233 A1 Nov. 7, 2002

Related U.S. Application Data

(60) Provisional application No. 60/280,906, filed on Apr. 2, 2001.

(51) Int. Cl.[7] ..... E04H 6/14

(52) U.S. Cl. ..... 414/234; 414/236; 414/237; 414/238; 414/249; 414/251

(58) Field of Search ..... 414/234, 236, 414/237, 238, 242, 245, 246, 247, 248, 249, 251, 239, 749.6; 198/748; 901/16

(56) References Cited

U.S. PATENT DOCUMENTS

| | | | | | |
|---|---|---|---|---|---|
| 2,830,714 | A | * | 4/1958 | Youtz | 198/465.3 |
| 2,911,115 | A | * | 11/1959 | Jacobsen, Jr. | 414/242 |
| 2,917,190 | A | * | 12/1959 | Francis | 198/802 |
| 2,936,082 | A | * | 5/1960 | Alimanestiano | 414/234 |
| 3,069,029 | A | * | 12/1962 | Wullschleger | 198/685 |
| 3,447,664 | A | * | 6/1969 | Goedkoop | 198/580 |
| 3,694,953 | A | | 10/1972 | Tomiyama | |
| 3,876,085 | A | * | 4/1975 | Bright | 414/239 |
| 3,887,089 | A | * | 6/1975 | Francis | 198/798 |
| 4,005,782 | A | * | 2/1977 | Crockett | 414/591 |
| 4,307,985 | A | | 12/1981 | Desprez et al. | |
| 4,600,358 | A | * | 7/1986 | Graf | 414/751.1 |
| 4,738,579 | A | | 4/1988 | Byrd | |
| 4,781,517 | A | * | 11/1988 | Pearce et al. | 414/590 |
| 5,018,926 | A | | 5/1991 | Sternad | |
| 5,129,776 | A | | 7/1992 | Peng | |
| 5,267,822 | A | | 12/1993 | Paravia et al. | |
| 5,314,284 | A | | 5/1994 | Tsai | |
| 5,314,285 | A | | 5/1994 | Lai | |
| 5,328,315 | A | | 7/1994 | Sakamoto et al. | |
| 5,478,182 | A | | 12/1995 | Hildebrand et al. | |
| 5,601,390 | A | * | 2/1997 | Cummings | 414/227 |
| 5,603,243 | A | * | 2/1997 | Finley | 74/490.07 |
| 5,810,539 | A | * | 9/1998 | Zhang et al. | 414/239 |
| 5,829,941 | A | | 11/1998 | Zamorano Morfin | |
| 5,893,696 | A | | 4/1999 | Belinsky | |
| 5,921,739 | A | * | 7/1999 | Keip | 211/126.11 |
| 5,980,185 | A | | 11/1999 | Vita | |
| 6,048,155 | A | | 4/2000 | Irish | |

FOREIGN PATENT DOCUMENTS

| | | | |
|---|---|---|---|
| EP | 265855 | * | 5/1988 |

* cited by examiner

*Primary Examiner*—James W. Keenan
(74) *Attorney, Agent, or Firm*—Clayton, Howarth & Cannon, P.C.

(57) ABSTRACT

A system for parking automobiles in a garage which uses a single-drive mechanism to simultaneously move automobile platforms. The automobile platforms reside in contiguous storage towers and are stacked in multiple levels. The automobile platforms simultaneously move in the towers. In one tower, the platforms move upward while the platforms in the other tower move downward. The automobile platforms rest on movement chains which move vertically among the various levels. The automobile platforms are moved from the vertical movement chains to a lateral movement means to move horizontally from tower to tower. The vertical movement system is powered by single-drive mechanism through a series of gears, sprockets and chains. Horizontal movement in the upper and lower lateral transfer areas is done by a lateral movement means.

55 Claims, 8 Drawing Sheets

PARKING GARAGE ELEVATOR SYSTEM

CROSS-REFERENCE TO RELATED APPLICATIONS

This application claims the benefit of U.S. Provisional Application No. 60/280,906, filed Apr. 2, 2001, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said portion of said above-referenced provisional application.

STATEMENT REGARDING FEDERALLY SPONSORED RESEARCH OR DEVELOPMENT

Not Applicable.

BACKGROUND OF THE INVENTION

1. The Field of the Invention

The present invention relates generally to parking garage elevator systems, and more particularly, but not entirely, to a parking garage system having simultaneously moving vehicle storage platforms.

2. Description of Related Art

Parking garage systems are useful because of the lack of parking space in urban areas. Parking garage systems are typically multi-level structures in which the automobiles are stored. Automobiles may travel from level to level by driving along an elevation ramp connecting the levels. Such multi-level garages increase the available parking space by providing the additional levels, thereby utilizing previously unused vertical space. However, the elevation ramp and drive-through lanes take up space.

Some parking garage systems have been developed to improve the multi-level garage concept by making it more compact. Some such systems utilize an elevator or other suitable lift system to move the automobile vertically to the desired level, and a separate moving platform or pallet to move the automobile horizontally into the desired parking space. Although such systems have indeed made multi-level parking garage designs more compact, the requirements of an elevator shaft (or series of elevator shafts) to contain the elevator or lifting means still takes up space that is rendered unusable for storing the vehicles. The elevator shafts are used to move the automobile vertically from level to level. Once the automobile arrives at a desired level, a movable platform or pallet is used to move the automobile horizontally from space to space. When all available storage spaces are used, the elevator shaft remains as unused space.

The prior art is characterized by garage systems that require a large amount of space for the operating equipment, and which is therefore not available for parking. The spaces used for elevator shafts or other lifting means take up valuable space that could be used for the storage of additional automobiles.

These and other disadvantages are addressed by the present invention. The present invention is, more efficient than the prior art designs in addressing the above-mentioned failures, and other problems, by utilizing the methods and structural features described herein.

BRIEF SUMMARY AND OBJECTS OF THE INVENTION

It is therefore an object of the present invention to provide a parking garage system that more efficiently utilizes the available space.

It is another object of the present invention, in accordance with one aspect thereof, to provide a parking garage system that is powered by a single-drive mechanism capable of powering two or more towers of simultaneously-moving automobile platforms.

It is a further object of the present invention, in accordance with one aspect thereof, to provide a parking garage system that allows automobiles to be stored in and retrieved from the system without the need for a separate elevator shaft in which the automobiles cannot be stored.

It is an additional object of the invention, in accordance with one aspect thereof, to provide a parking garage system having an array of storage platforms that operate to move in a circulating manner to allow automobiles to be loaded and unloaded from the system faster on the average than other automobile elevator systems.

The above objects and others not specifically recited are realized in a specific illustrative embodiment of a parking garage system having automobile storage platforms that move generally simultaneously and in a circulating manner. The apparatus includes a plurality of automobile storage platforms that are supported by a support structure and powered in a preferably vertical direction by a single-drive mechanism. The automobile platforms are equipped with traction mesh to prevent the automobiles from slipping when the system is in motion, and drip pans to contain fluids that might drip from the automobiles. The single-drive mechanism is driven by a power supply, which provides power to a series of sprocket gears through a drive gear in a reduction box. The sprocket gears turn a plurality of preferably vertical movement chains, which mesh with a series of support sprocket gears. The automobile platforms rest on pins attached to said movement chains.

The automobile platforms and support structures are preferably arranged in at least two storage towers having multiple levels, with said towers having a width that is preferably equivalent to (or slightly larger than) the automobile platforms. When the drive mechanism is engaged, the automobile platforms simultaneously moves upward in one storage tower and downward in the other storage tower. This simultaneous vertical movement allows one platform to be elevated to another level for storage while the platforms in the other tower will move downward toward ground level. A lateral movement means horizontally moves the platforms one at a time from one tower to the other preferably at the upper-most level, while a conveyer means laterally transfers the platforms one at a time in the lower storage area.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
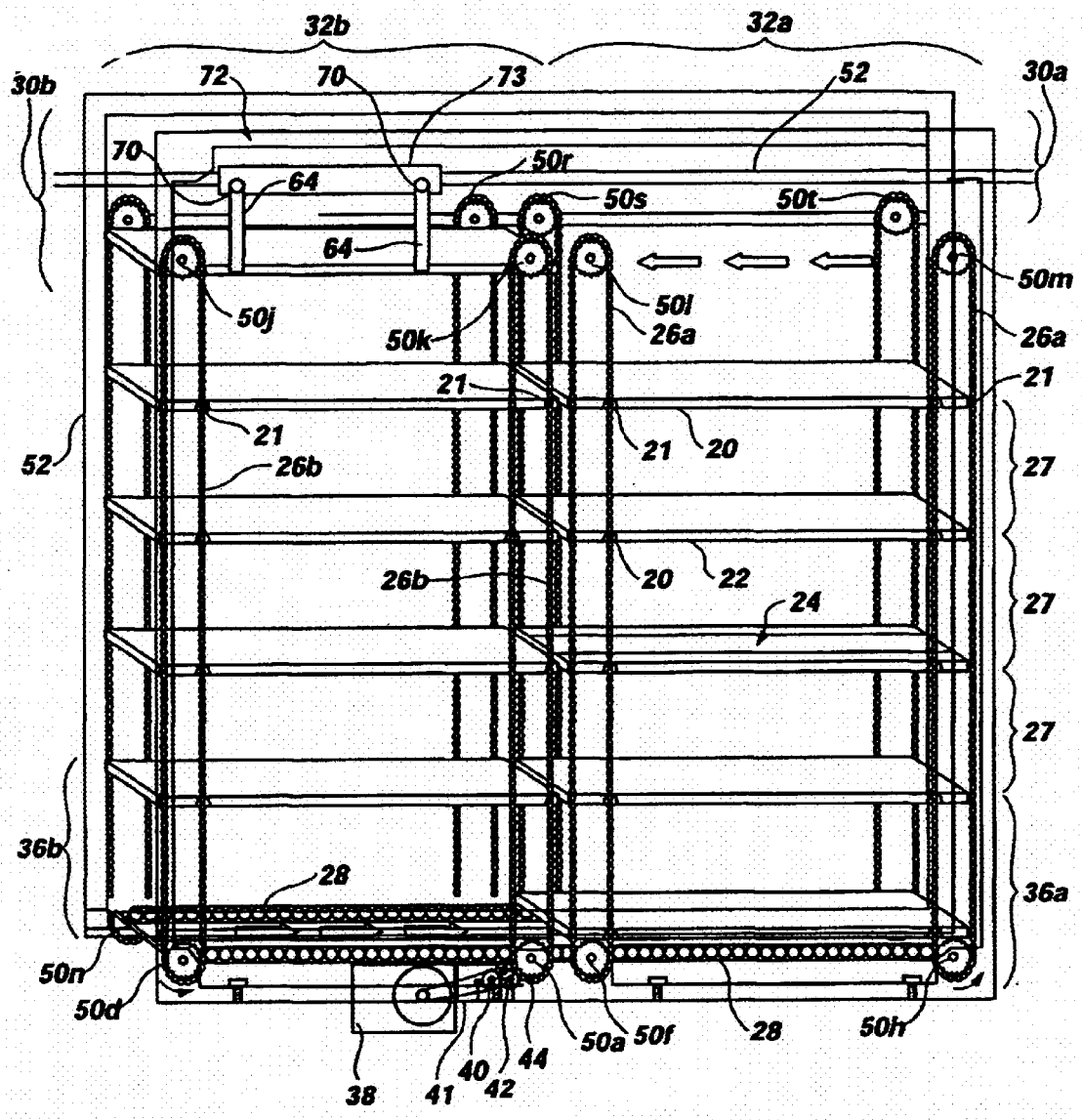
FIG. 1 is a schematic, perspective view of a parking garage elevator system, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It is to be understood that this invention is not limited to the particular configurations, process steps, materials and features disclosed herein as such configurations, process steps, materials and features may vary somewhat. It is also to be understood that the terminology employed herein is used for the purpose of describing particular embodiments only and is not intended to be limiting, since the scope of the present invention will be limited only by the appended claims and equivalents thereof.

The publications and other reference materials referred to herein to describe the background of the invention and to provide additional detail regarding its practice are hereby incorporated by reference herein. The references discussed herein are provided solely for their disclosure prior to the filing date of the present application. Nothing herein is to be construed as a suggestion or admission that the inventor is not entitled to antedate such disclosure by virtue of prior invention.

It must be noted that, as used in this specification and the appended claims, the singular forms "a," "an," and "the" include plural referents unless the context clearly dictates otherwise.

In describing and claiming the present invention, the following terminology will be used in accordance with the definitions set out below.

As used herein, "comprising," "including," "containing," "characterized by," and grammatical equivalents thereof are inclusive or open-ended terms that do not exclude additional, unrecited elements or method steps.

As used herein, the term "vehicle", and grammatical equivalents thereof, refers to any device used for transportation of an object from one location to another, whether the device is self-propelled or not. The term "vehicle" is intended to include, but is not limited to: any automobiles (including cars or trucks), water craft (including boats and barges), airplanes, motorcycles, all terrain vehicles, tractors, bicycles or other devices used for transportation.

Applicant has discovered that the space-saving benefits of a parking garage are greatly enhanced by a garage having side-by-side, contiguous storage sections or towers, without the need for an elevator shaft between the storage towers. This arrangement is rendered useable by providing a plurality of automobile support platforms that move simultaneously and circulate in sequence from one storage tower to another. By causing the automobile storage platforms to move simultaneously and in tandem with each other, in a circulating movement path, the need for a temporary displacement space, such as a central elevator shaft, is unnecessary.

Referring now to FIG. 1, there is shown a side view of a parking garage elevator system, designated generally at 10. The system 10 includes a plurality of automobile platforms 20. Traction pads 22 are preferably disposed on an upper surface of each platform 20, for receiving the wheels of an automobile (not shown) thereupon. The traction pads 22 would inhibit any slipping of the automobiles during movement of the automobile platforms 20. The automobile platforms 20 also contain a drip pan 24 to collect any fluids dripping off of a vehicle and to shield the automobile below from becoming soiled.

Figure 1A:
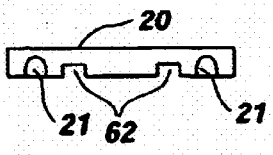
FIG. 1A is a close-up view of an automobile platform shown in FIG. 1.
Figure 1B:
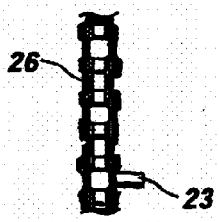
FIG. 1B is a close-up view of a section of a vertical movement chain shown in FIG. 1.

FIG. 1A (a partial view of a platform 20 shown in FIG. 1) shows two downward-facing, preferably U-shaped, brackets 21 that attach to the two longitudinal edges of the automobile platform 20 and wherein said brackets 21 extend from the sides of the platform 20, such that each platform 20 preferably carries four brackets 21. Referring again to FIG. 1, the U-brackets 21 on the platforms 20 in the upward vertical storage tower 32*a* align with the upward vertical movement chains 26*a*. Similarly, the U-brackets 21 on the platforms 20 in the downward vertical storage tower 32*b* align with the downward vertical movement chains 26*b* in the downward vertical storage tower 32*b*. FIG. 1B (a close-up view of a section of the vertical movement chains 26 shown in FIG. 1) shows a pin 23 attached to a vertical movement chain 26. Referring again to FIG. 1, the pins 23 are spaced such that the distance between them corresponds to the height of one level 27 of the parking garage system 10. The storage levels 27 are preferably equivalent in height to one another.

The U-brackets 21 engage the pins 23, which are attached to the upward and downward vertical movement, chains 26, and allow the platforms 20 to rest on the pins 23. The four vertical movement chains 26*a* in the upward moving storage tower 32*a* move simultaneously in an upward direction. As the upward vertical movement chains 26*a* move in an upward direction, the platforms 20 are caused to ascend upwardly within the upward moving storage tower 32*a*. Platforms 20 descend in the downward moving storage tower 32*b* as the downward vertical movement chains 26*b* move at; the same speed and at the same time in tandem with the upward vertical movement chains 26*a*. When a platform 20 reaches the upper lateral transfer area 30*a* of the upward moving storage tower 32*a*, a separate platform 20 in the downward moving storage tower 32*b* simultaneously reaches the lower lateral transfer area 36*b*. Vertical movement of the vertical movement chains 26 stops when a platform 20 reaches a lateral transfer area 36*b* or 30*a* in the appropriate storage tower 32, responsible to any suitable sensing and stopping means known to those of ordinary skill in the art. Said platforms 20 are now in position to move laterally to the other storage tower 32.

Figure 1C:
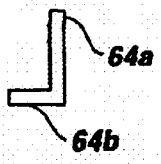
FIG. 1C is a side view of a swing arm depicted in FIG. 1.

In one embodiment, horizontal movement in the upper lateral transfer area 30*a–b* is accomplished with L-shaped swing arms 64. The L-shaped swing arms 64 are attached to a lateral movement means 72 with a hinge 70. The lateral movement means 72 has a sleeve 73 that is slidably circumscribed around the support structure 52. Referring to FIG. 1A, the automobile platforms 20 may have four slots 62 formed therein, two of which are preferably located on each of the bottom longitudinal edges of said platform 20. These slots 62 receive the bottom portion 64*b* of L-shaped swing arms 64 as shown in FIG. 1C (a partial view showing a side view of the swing arm 64 depicted in FIG. 1).

Referring again to FIG. 1, the L-shaped swing arms 64 preferably robotically swing into position with the bottom portion 64*b* of the swing arm 64 fitting in to the four slots 62 of the platform 20, in any suitable manner known to those skilled in the field of robotics or other movement mechanics. The four swing arms 64 preferably swing on a hinge 70. The hinge 70 is attached to a lateral movement means 72. The lateral movement means 72 functions to move said platform 20 laterally to the downward storage tower 32*b*. The lateral movement means 72 preferably first lifts the platform 20 until the platform 20 is high enough to clear the pins 23 attached to the vertical movement chains 26. (Alternatively, spring-pivot U brackets 25 of FIG. 6A could be used in lieu of brackets 21, to eliminate the need to lift the platform. The lateral movement means 72 then is caused to slide along the support structure 52 in any suitable manner known to those of ordinary skill in the field, to thereby laterally transfer the platform 20 from the upward storage tower 30*a* to the downward moving storage tower 32*b*. The lateral movement means 72 then lowers the platform 20 until the U-brackets 21 rest on the pins 23 (see FIG. 1B) attached to the downward vertical movement chains 26*b* in the downward storage tower 32*b*. After the platform 20 is lowered onto the pins 23, the swing arms 64 are caused in any suitable manner to swing in an upward direction and out of the path of the platform 20. The lateral movement means 72 then returns to its original position in the upward moving storage tower 32*a* until the next platform 20 is raised into the upper lateral transfer area 30*a*.

The platform 20 in the downward moving storage tower 32*b* then descends in said tower 32*b* on the downward moving vertical chains 26*b* until a platform 20 reaches the lower lateral transfer area 36*b*. Any suitable conveyance means, such as two conveyer belts 28, preferably span the lower lateral transfer area 36*b*. As the platform 20 lowers, the bottom of said platform 20 comes in contact with and rests upon the conveyer belts 28. The downward vertical movement chains 26*b* continue downward and the pins 23 attached to said chains 26*b* descend below the platform 20, and the chains 26*a* and 26*b* are caused to stop responsive to any suitable sensing and stopping means. The conveyer belts 28 laterally transfer the platform 20 to the upward moving storage tower 32*a*, in simultaneous tandem with the lateral transfer of a platform 20 in the upper lateral transfer area 30*a–b*.

Figure 2:
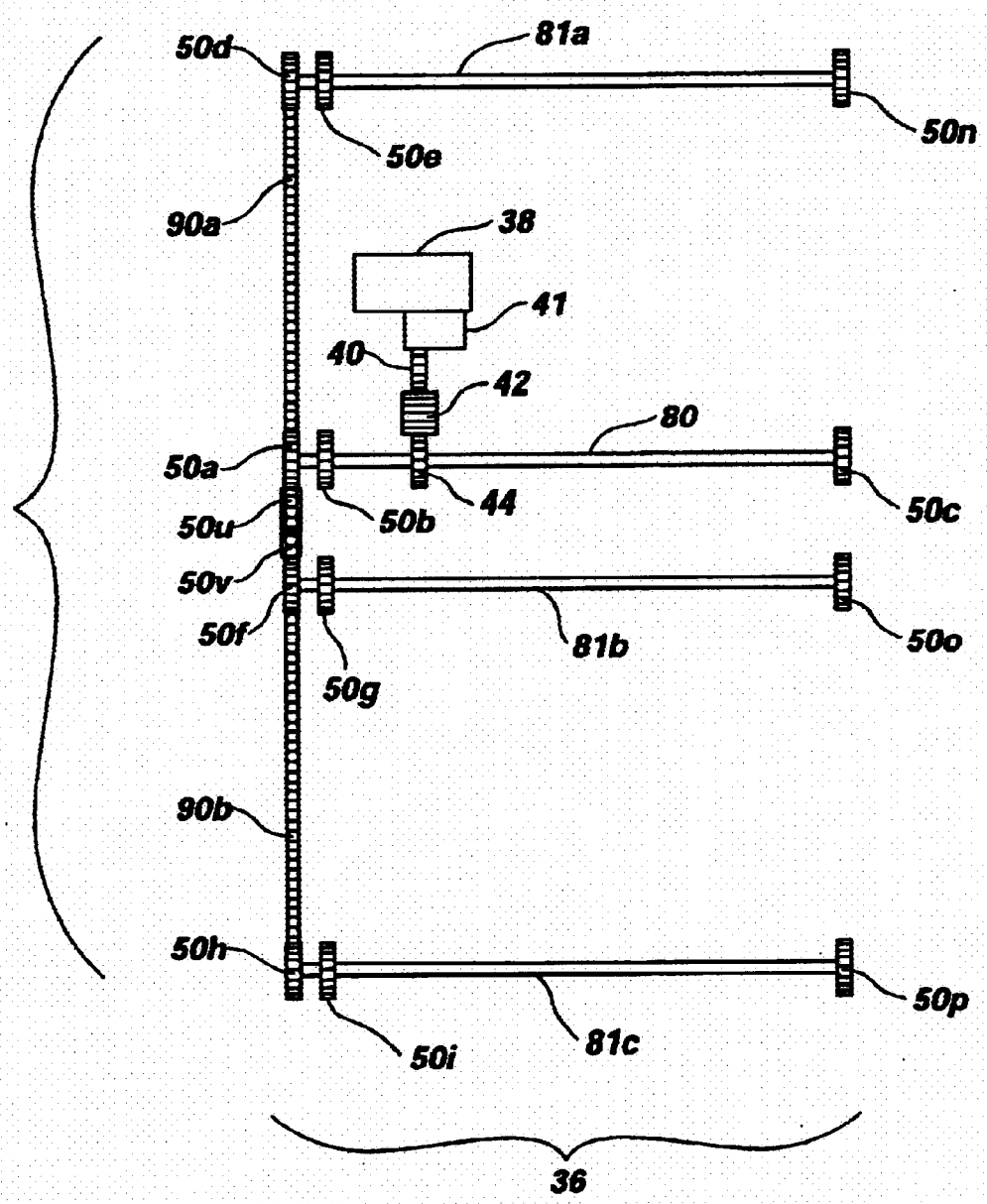
FIG. 2 a partial, top view of the garage system power supply and drive chain mechanisms shown in FIG. 1.

FIG. 2 illustrates a partial, top view of the garage system 10 power supply 38 and drive chain 90 mechanisms. The garage system 10 is powered by a power supply 38. The power supply 38 propels a gear reduction transfer box 41. The gear reduction transfer box 41 turns a drive gear 40, which in turn meshes with a transfer gear 42. The transfer gear 42 meshes with an axle gear 44. The axle gear 44 is affixed to a drive axle 80 that spans the width of the garage system 10, and preferably is wider than a platform 20. Two, sprockets 50*a* and 50*b* (not shown in FIG. 1) are fixed to the proximate (front) end of the drive axle 80, while a single sprocket 50*c* is fixed to the distal end of said drive axle 80. The outside sprocket 50*a* on the proximate end of drive axle 80 meshes with a first master drive chain 90*a*. The first drive chain 90*a* in turn meshes with sprocket 50*d*, and transfer gear 50*u*, which drives transfer gear 50*v*, and gear 50*v* drives second drive chain 90*b*, which drives sprockets 50*f* and 50*h* in the lower lateral transfer area 36*a–b*. The outside sprockets at locations 50*d*, 50*f* and 50*h* are attached to axles 81*a*, 81*b* and 81*c* respectively. Inside sprockets 50*e*, 50*g* and 50*i* are also attached to said axles 81*a*, 81*b* and 81*c* respectively, in the same manner as the two sprockets 50*a* and 50*b* are attached to the drive axle 80 when the drive mechanisms are engaged, the drive axle 80 turns sprocket 50*a*, said sprocket 50*a* meshes with the master drive chain 90, which in tarn meshes with sprockets 50*d*, 50*f* and 50*h* and drives axles 81*a*, 81*b* and 81*c*.

Inside sprockets 50*e*, 50*g* and 50*i* attach to axles 81*a*, 81*b* and 81*c* respectively, and sprocket 50*b* attaches to the drive axle 80. Said sprockets 50*e*, 50*g*, 50*i* and 50*b* mesh with the movement chains 26 on the proximate (front) side of the system 10. Referring to FIG. 1, the vertical movement chains 26 drive the upper sprockets 50*j*, 50*k*, 50*l* and 50*m* on the front of the garage system 10, said upper sprockets 50*j*, 50*k*, 50*l* and 50*m* being attached to the support structure 52, in the upper lateral transfer area 30. Referring again to FIG. 2, the distal sprockets 50*n*, 50*o* and 50*p* attached to axles 81*a*, 81*b* and 81*c*, respectively, and sprocket 50*c* attached to drive axle 80, mesh with movement chains 26 on the distal (back) side of the system 10. Referring to FIG. 1, said movement chains 26 mesh with the upper sprockets 50*q*, 50*r*, 50*s* and 50*t* on the back of the garage system 10 in the upper lateral transfer area 30, said upper sprockets 50*q*, 50*r*, 50*s* and 50*t* being attached to the support structure 52. By utilizing the two transfer gears 50*u* and 50*v*, upward vertical movement chains 26*a* and downward vertical movement chains move in opposite directions, respectively.

Figure 3:
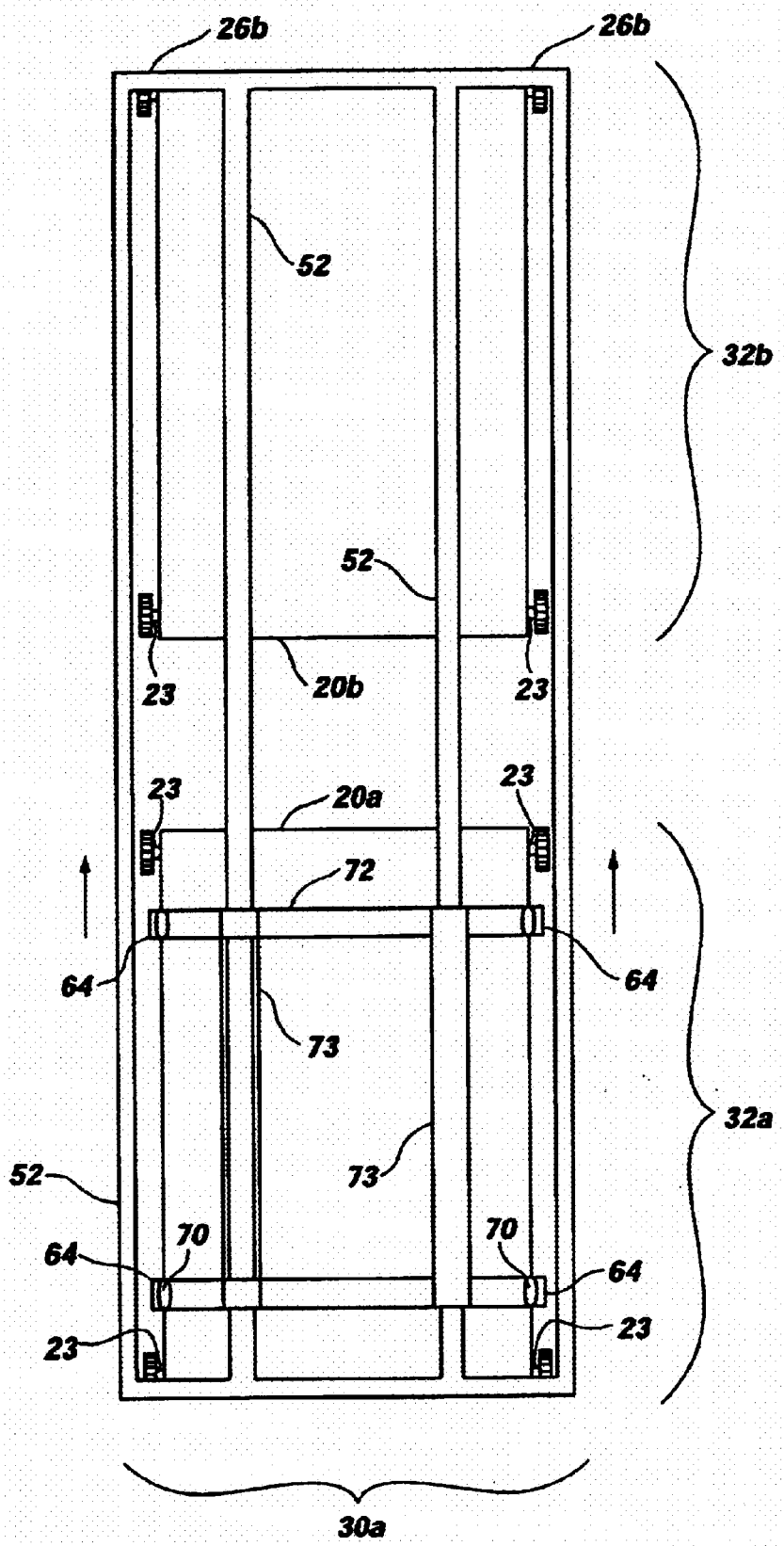
FIG. 3 is a top view of the parking garage elevator system of FIG. 1.

Referring now to FIG. 3, a top view of the parking garage elevator system showing automobile platform 20*a* in the upper lateral transfer area 30*a* of the upward vertical storage tower 32*a* and automobile platform 20*b* in the downward vertical storage tower area 32*b*, said platform 20*b* being one level below the upper horizontal transfer area 30. The automobile platform 20*a* in the upward vertical storage tower area 32*a* is in position to move horizontally to the downward vertical storage tower 32*b*. Swing arms 64 swing on a hinge 70 and lock in the lateral movement position. The upper lateral movement means 72 lifts the platform 20*a* above the pins 23 on the upward vertical movement chains 26*a*, then laterally moves the platform 20 across the support structure 52 until the platform 20*a* reaches the downward vertical storage tower 32*b*. The platform 20*a* is lowered until the four U-brackets 21 on the platform 20*a* rest on the four pins 23 attached to the downward moving vertical chains 26*b* in the downward vertical storage tower 32*b*.

Figure 4:
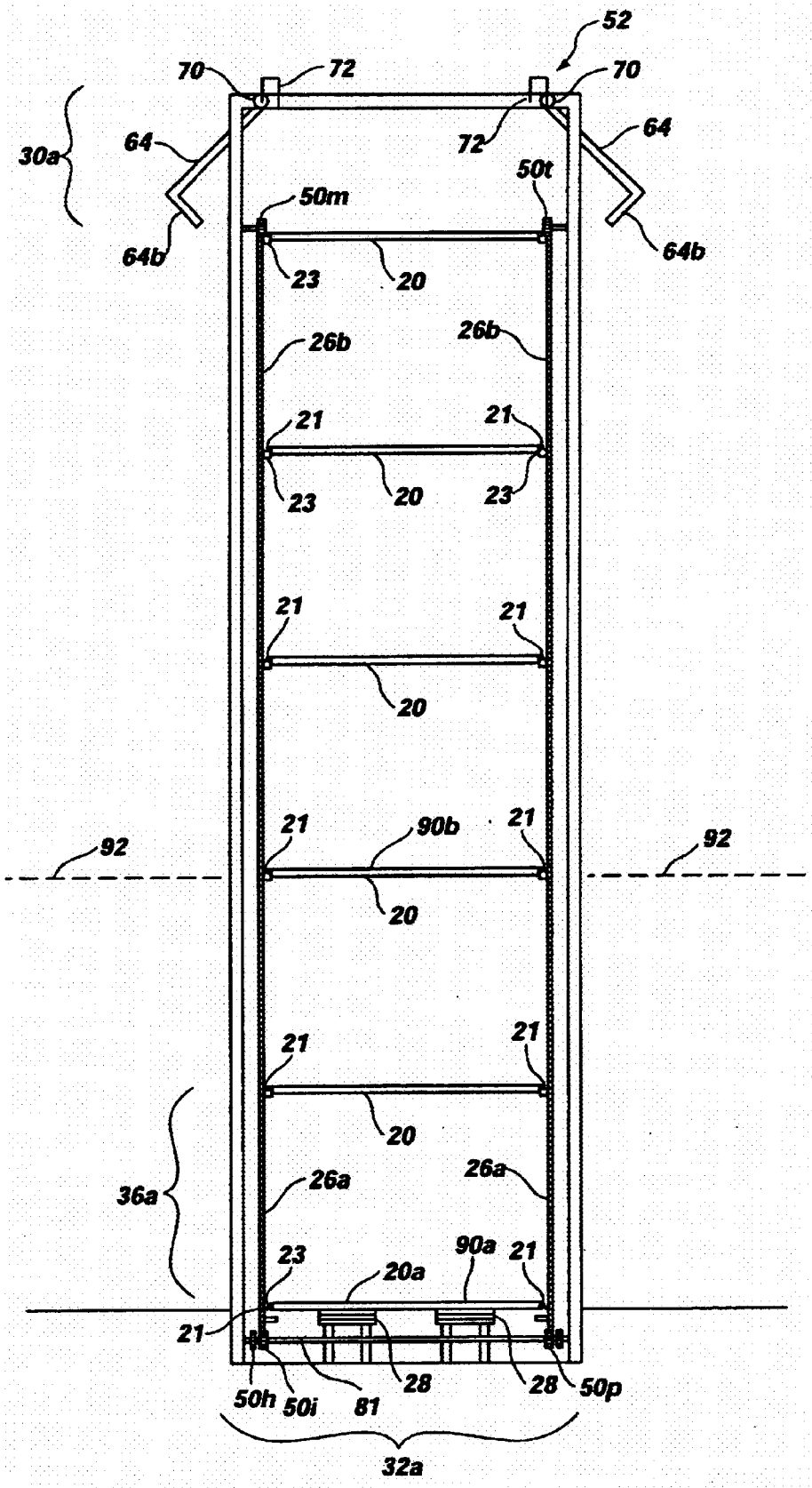
FIG. 4 is a front view of the parking garage elevator system of FIG. 1.

Referring now to FIG. 4, a front view of the parking garage elevator system is shown having an automobile platform 20*a* in the lower lateral transfer area 36*a* of the upward vertical storage tower 32*a*, said platform 20*a* resting on conveyer belts 28 and the pins 23 being attached to the upward vertical movement chains 26*a* and below said platform 20*a*. The other platforms 20 are resting via their attached U-brackets 21 on pins 23 attached to the upward vertical movement chains 26*a*. The upward vertical movement chains 26*a* mesh with sprockets 50*m* and 50*t* at the top of the garage system 10, and with sprockets 50*i* and 50*p* at the bottom of the garage system 10. Said sprockets 50 are attached to the support structure 52.

It will be appreciated that the structure and apparatus disclosed herein is merely one example of a lateral movement means 72, and it should be appreciated that any structure, apparatus or system for lateral movement which performs functions the same as, or equivalent to, those disclosed herein are intended to fall within the scope of a means for lateral movement, including those structures, apparatus or systems for lateral movement which are presently known, or which may become available in the future. Anything which accomplished functions that are the same as, or equivalently to, a means for lateral movement falls within the scope of this element.

Figure 5:
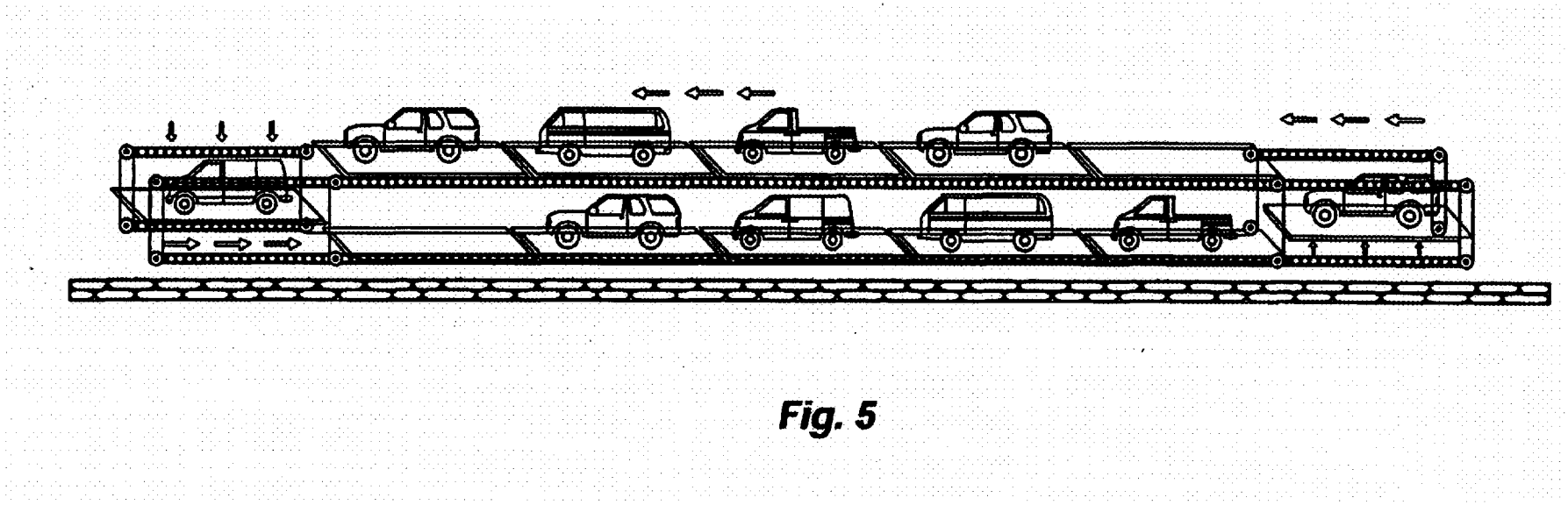
FIG. 5 is an alternative embodiment of the parking garage elevator system of FIG. 1.

FIG. 5 shows an alternative embodiment of the parking garage elevator system of FIG. 1. The features and workings of this alternate embodiment include the same elements (not shown) as the system 10 in FIG. 1. The difference in this alternate embodiment is the orientation and means for horizontal movement. In this embodiment, the system stores the automobiles horizontally rather than vertically, and horizontal movement of the platforms 20 is accomplished with any suitable alternative embodiment of a means for horizontal movement that could occur to one of ordinary skill in the relevant art having possession of this disclosure.

Figure 6:
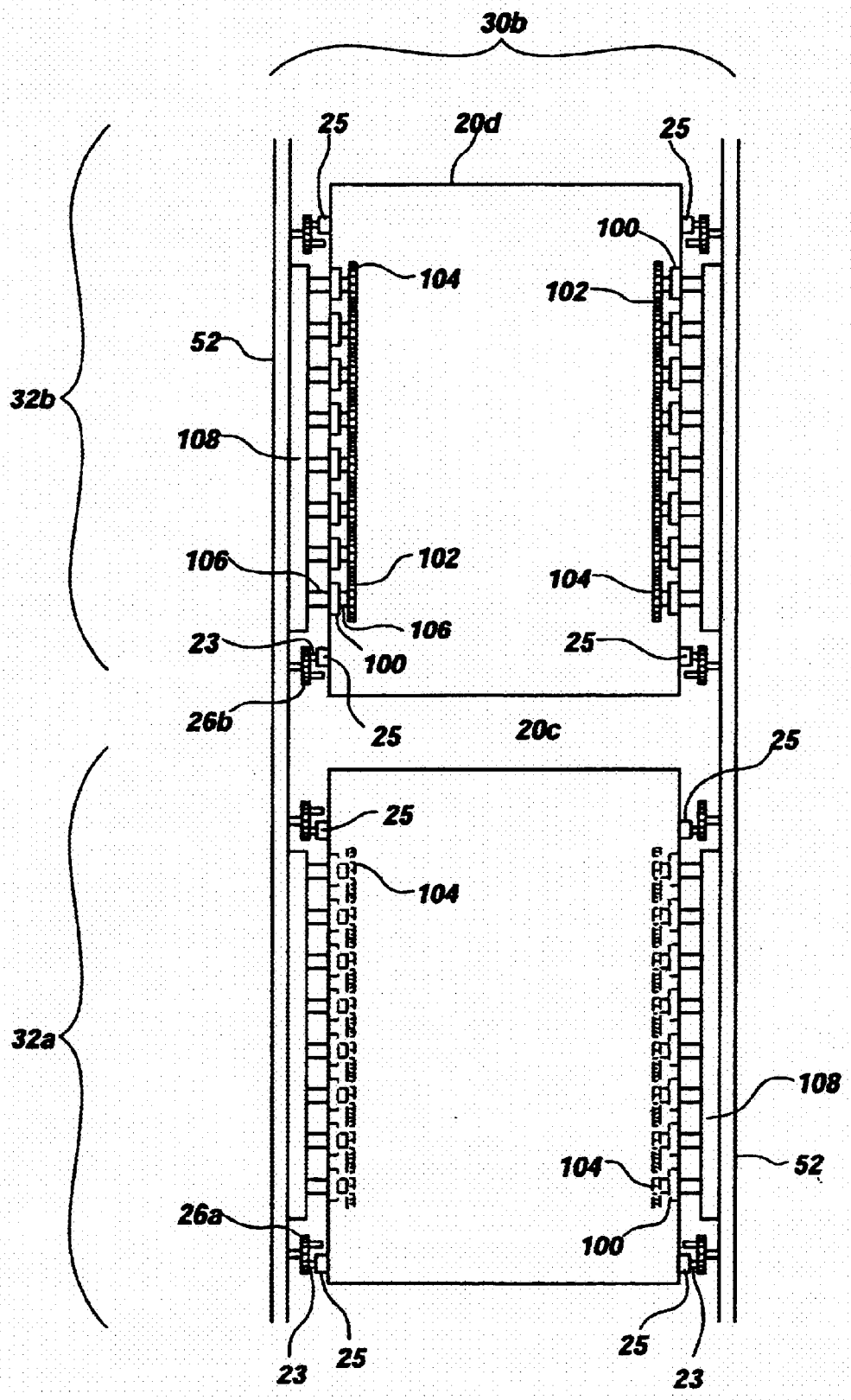
FIG. 6 is a top view of an alternative embodiment of the means for horizontal movement of FIG. 1.

Referring now to FIG. 6, a top view of the alternative embodiment of a means for horizontal movement is shown. The alternative embodiment for the horizontal movement means shown in FIG. 6 has the same elements and reference numerals as the embodiment for the garage system 10 in FIGS. 1–4, with the exception of the alterative means for horizontal movement. Platform 20*c* is shown in the upper lateral transfer area 30*b* of the upward vertical storage tower 32*a*, while platform 20*d* is in the downward vertical storage tower 32*b*, one level below the upper lateral transfer area 30*b*. In this embodiment, spring pivot U-brackets 25 are attached to the platform 20.

Figure 6A:
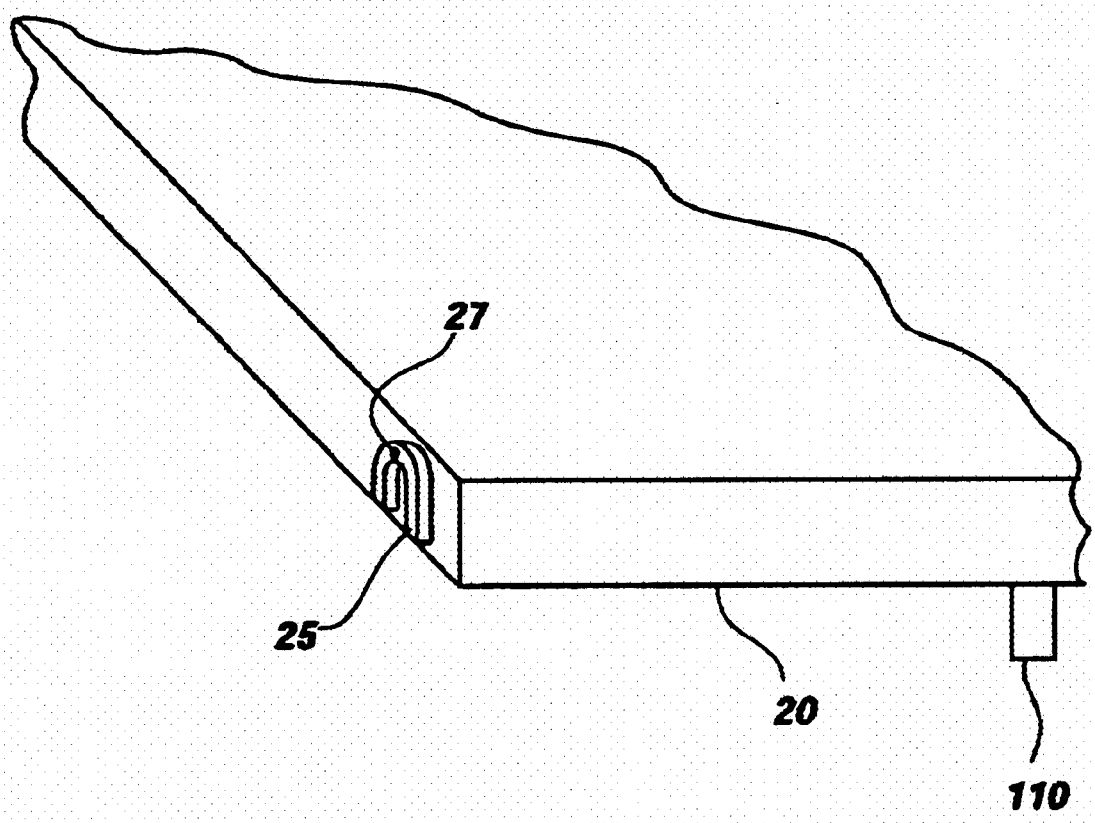
FIG. 6A is a close-up view of a spring pivot U-bracket shown in FIG. 6.

The platforms 20 do not need to be raised above the pins 23 for lateral movement. Referring to FIG. 6A (a close-up view of the spring pivot U-brackets 25 as shown in FIG. 6), the spring pivot U-brackets 25 may pivot back and forth by operation of a spring pivot hinge 27 (or its functional equivalent) which allows the U-bracket 25 to pivot. This spring pivot hinge 27 allows the platform 20 to slide off of the pins 23 without the need to lift the platform 20 over the pins 23. The brackets 25 simply pivot responsive to contact with the pins 23 when the platform 20 is moved in a lateral direction.

Referring again to FIG. 6, as the platform 20 moves laterally, the pin 23 on the vertical movement chain 26*a* causes the spring pivot U-bracket 25 to pivot. As the platform 20 continues to move laterally, the spring pivot U-bracket 25 releases the pin 23 and pivots back to its original position by operation of the spring pivot hinge 27. As the platform 20 laterally moves to the next storage tower 32, the spring pivot U-bracket 25 on the platform 20 pivots as said bracket 25 comes in contact with the pin 23 on the vertical movement chain 26*b*. Once the center of the spring pivot U-bracket 25 is above the pin 23, the spring pivot U-bracket 25 pivots back to its original position as is now surrounding the pin 23. This engagement of the pins 23 and spring pivot U-brackets 25 occurs substantially simultaneously with all four spring pivot U-brackets 25 attached to said platform 20. The platform 20 is now resting on the vertical movement chains 26 and is in position to move vertically.

In the embodiment shown in FIG. 6, horizontal movement of the platforms 20 is accomplished with idler wheels 100 and horizontal movement chains 102. The idlers 100 and horizontal movement chain sprockets 104 are attached to a shaft 106. The shaft 106 is attached to a beam 108, which is movably attached to the support structure 52 in a manner than allows the beams 108 to pivot.

Figure 7B:
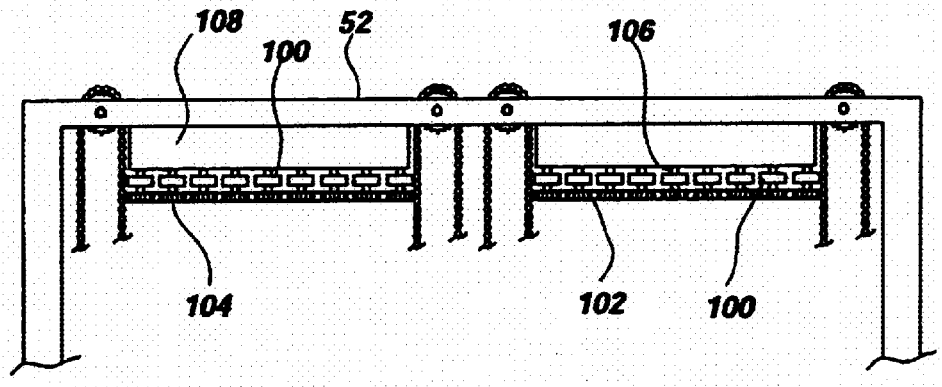
FIG. 7B is partial side view of the alternative embodiment of a means for horizontal movement as shown in FIG. 6.
Figure 7A:
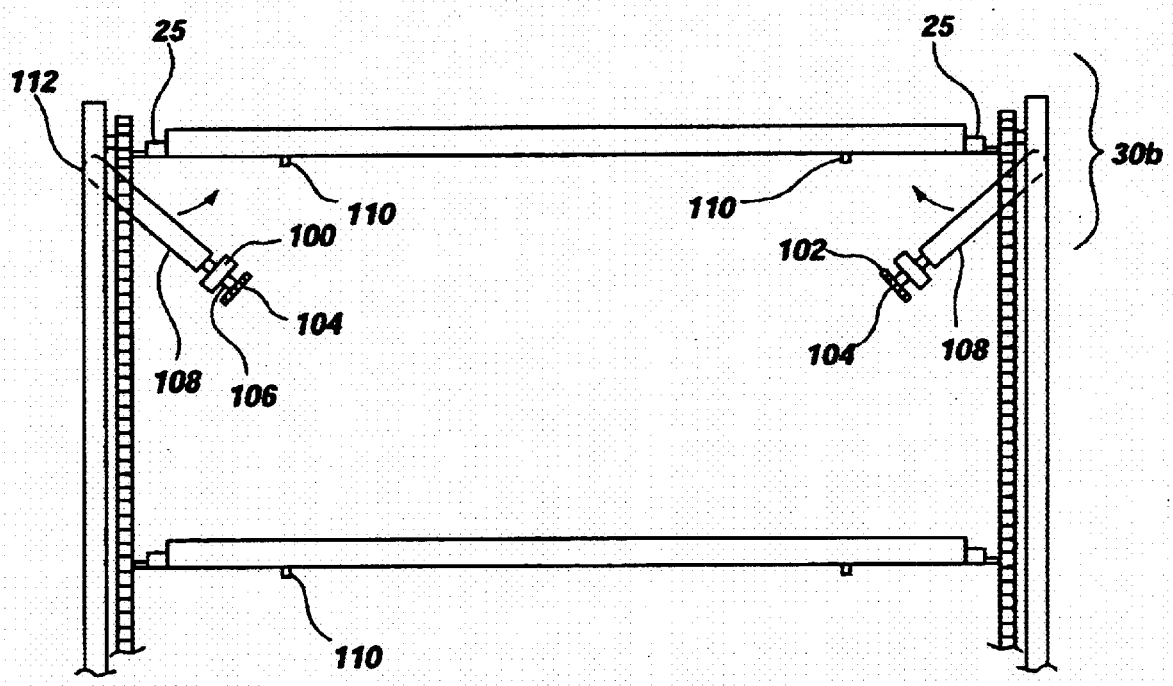
FIG. 7A is a partial front view of the alternative embodiment of a means for horizontal movement as shown in FIG. 6.

Referring now to FIG. 7A, a close up side view of the alternative embodiment of a means for horizontal movement shown in FIG. 6, as a platform 20 arrives in the lateral transfer area 30*b*, the beams 108 pivot and any suitable locking means 112 locks the beams 108 in place. This motion (indicated with arrows) allows the rollers 100 to swing upward and into contact with the platform 20. The horizontal movement chains 102 also swing upward and mesa with teeth 110 attached to the lower side of the platform 20. The horizontal movement chains 102 are then caused by drive sprockets 104 to move the platform 20 laterally. In this embodiment, the spring loaded U-brackets 25 are attached to the platforms 20 and function as described above. The idlers 100 and horizontal movement chains 102 can also be used for horizontal movement in the lower lateral transfer area 36.

Referring now to FIG. 7B, a partial front view of the alternative embodiment of a means for horizontal movement shown in FIG. 6, the beams 108 are shown retracted. This position allows the platforms 20 to move vertically. The idlers 100, horizontal movement sprockets 104 and horizontal movement chains 102 are also shown retracted.

It will be appreciated that the structure and apparatus disclosed herein are merely examples of a parking garage elevator system 10, and it should be appreciated that any structure, apparatus or system for a simultaneous parking garage system which performs functions the same as, or equivalent to, those disclosed herein are intended to fall within the scope of a means for said simultaneous parking garage system, including those structures, apparatus or systems for said simultaneous parking garage system which are presently known. Anything which functions the same as, or equivalently to, a means for said simultaneous parking garage system falls within the scope of this element.

In accordance with the features and combinations described above, a preferred method of the simultaneous parking garage system 10 includes:

(a) a parking garage system 10 comprising two vertical storage towers 32 consisting of multiple levels 27;

(b) automobile platforms 20 transported vertically by movement chains 26;

(c) an upper lateral transfer area 30 consisting of idlers 100 and horizontal movement chains 102; and (d) a lower lateral transfer area 36 consisting of idlers 100 and horizontal movement chains 102.

It will be appreciated that the simultaneous parking garage system 10 provides a parking garage that efficiently utilizes the space. The simultaneous movement of the automobile platforms 20 provided by the vertical movement chains 26 alleviates the need for elevator shafts. This provides more space for the parking of automobiles because there is no space in the system dedicated for an elevator shaft.

The simultaneous movement of the automobile platforms 20 also simplifies the process of loading and unloading automobiles from the system. This is most beneficial when a car needs to be unloaded. In some conventional parking garage systems, retrieval of an automobile requires the movement of other automobiles to gain access to the automobile that needs to leave the system. The present invention allows an automobile to exit the system without re-arranging other automobiles. The system merely has to circulate until the desired automobile platform 20 is at an exit level. Either lower-level position 90*a* (FIG. 4) may be used as an entry or exit. Alternatively, the system 10 may be partially subterranean, if by example ground level is at 92 (FIG. 4), in which case position 90*b* could function as an entry or exit.

The simultaneous system also makes loading and unloading faster because the user does not have to wait for an elevator to go up and come back down before the next automobile is loaded or unloaded. The reversibility of the system also decreases the time required to load and unload. Any suitable enhancement may also be added. For example, removable wheel blocks may be placed about a wheel of a stored vehicle to prevent it from rolling forward. Any suitable means for temporarily preventing movement of the car on the platform is within the scope of invention.

It should be appreciated to one skilled in the art that the present invention is not limited in scope to the storage of vehicles. The elevator system and storage platforms could be configured and arranged to store any object.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein,

What is claimed is:

1. A parking garage elevator system for storing vehicles, said system comprising:

a plurality of platforms for storing a plurality of vehicles thereon; and circulation means for moving the platforms along an endless circulation path having un upward-movement portion and a downward-movement portion to thereby cause the platforms to move in sequence along said path, such that each platform passes through a first position along said circulation path;

wherein the circulation means further comprises a plurality of chains, wherein each of the plurality of chains comprises a plurality of cantilevered pins extending orthogonal to a direction of movement of said chains and outwardly therefrom, respectively, and into engagement with the platforms or a member directly attached to said platforms to thereby lift said platforms responsive to upward movement of the circulation means.

2. The system of claim 1, wherein the platforms are preferably arranged in first and second storage towers, wherein at least two platforms reside within each of said towers, wherein said platforms are horizontally stacked one above the other to thereby define a vertical space therebetween for storing a vehicle, each tower having at least two storage levels including an upper level and a lower level, wherein at least two platforms reside adjacent to each other at some point along the circulation path.

3. The system of claim 1, wherein the circulation means comprises a vertical movement means and a horizontal movement means.

4. The system of claim 3, wherein the circulation means further comprises movement means for imparting alternating vertical and horizontal movement to at least some of the platforms.

5. The system of claim 4, wherein the movement means comprises a means for providing unidirectional movement to said platforms without a reversal in movement; direction.

6. The system of claim 4, wherein the movement means comprises a means for providing unidirectional movement to said platforms, and a reversing means for reversing a movement direction of said platforms.

7. The system of claim 4, wherein the circulation means further comprises movement means for moving platforms within a first storage tower in an upward direction while moving platforms within a second storage tower in a downward direction.

8. The system of claim 3, wherein the vertical movement means comprises a system of chains and sprockets.

9. The system of claim 3 wherein the horizontal movement means comprises a conveyer system.

10. The system of claim 3 wherein the horizontal movement means comprises a lifting mechanism.

11. The system of claim 1, wherein the circulation means comprises a lateral movement means for moving the platforms in a lateral direction, said lateral movement means comprising a lateral transfer system of idlers, chains and sprockets.

12. The system of claim 11, wherein the lateral movement means comprises positioning means for moving the lateral transfer system from an idle position to a transfer position residing beneath a platform.

13. The system of claim 1, wherein the circulation means further comprises a vertical movement means, said vertical movement means comprising a plurality of endless chains disposed in meshing engagement with a plurality of gear members, respectively.

14. The system of claim 13, wherein the chains each include lifting means for lifting an object.

15. The system of claim 14, wherein the lifting means comprises a plurality of pins extending outwardly from links of the chains.

16. The system of claim 1, wherein the circulation means further comprises lateral movement means for moving the platforms in a lateral direction.

17. The system of claim 1, wherein the circulation means comprises a lateral movement means for moving the platforms in a lateral direction, and wherein the lateral movement means comprises positioning means for moving the lateral transfer system from an idle position to a transfer position residing beneath a platform.

18. The system of claim 1, wherein a portion of said system resides in a subterranean location.

19. The system of claim 18, wherein at least one-third of said system resides in a subterranean location.

20. The system of claim 1, wherein said system resides on a means for moving the system.

21. A parking garage elevator system for storing vehicles, said system comprising:

a plurality of platforms for storing a plurality of vehicles thereon; and circulation means for moving the platforms along an endless circulation path having un upward-movement portion and a downward-movement portion to thereby cause the platforms to move in sequence along said path, such that each platform passes through a first position along said circulation path;

wherein the circulation means further comprises a vertical movement means, said vertical movement means comprising a plurality of endless chains disposed in meshing engagement with a plurality of gear members, respectively;

wherein the chains each include lifting means for lifting an object;

wherein the lifting means comprises a plurality of pins extending outwardly from links of the chains; and wherein the vertical movement means further comprises a set of four endless chains comprising a first, second, third and fourth endless chain each extending in an upward direction, each endless chain being disposed in meshing engagement with at least two opposing gear members, wherein the first and second endless chains reside on a first side of the platforms and the third and fourth endless chains reside on a second side of the platforms, said chains being positioned such that some of the pins reside in contact with a portion of the platforms.

22. The system of claim 21, wherein each platform includes a plurality brackets extending outwardly from sides of the platform.

23. The system of claim 22, wherein at least some the brackets are rotatably disposed on the sides of the platforms.

24. The system of claim 23, wherein the brackets are rotatably disposed in a first position, further comprising:

return-action means for returning the brackets to the first position responsive to displacement of said brackets from said first position.

25. The system of claim 22, wherein the chains are positioned such that the pins reside in alignment with at least one of the brackets.

26. The system of claim 25, wherein the chains are positioned such that the pins reside in vertical alignment with at least one of the brackets.

27. A parking garage elevator system for storing vehicles, said system comprising:

a plurality of platforms for storing a plurality of vehicles thereon;

support means for supporting said platforms in separate, spaced-apart storage positions, respectively; and moving means for moving the platforms simultaneously to thereby advance any selected platform to a loading or unloading position;

wherein the moving means further comprises a vertical movement means, said vertical movement means comprising a plurality of endless chains disposed in meshing engagement with a plurality of gear members, respectively;

wherein the chains each include lifting means for lifting an object;

wherein the lifting means comprises a plurality of pins extending outwardly from links of the chains; and wherein the vertical movement means further comprises a set of four endless chains comprising a first, second, third and fourth endless chain each extending in an upward direction, each endless chain being disposed in meshing engagement with at least two opposing gear members, wherein the first and second endless chains reside on a first side of the platforms and the third and fourth endless chains reside on a second side of the platforms, said chains being positioned such that some of the pins reside in contact with a portion of the platforms.

28. The system of claim 27, wherein each platform includes a plurality brackets extending outwardly from sides of the platform.

29. The system of claim 28, wherein at least some the brackets are rotatably disposed on the sides of the platforms.

30. The system of claim 29, wherein the brackets are rotatably disposed in a first position, further comprising:

return-action means for returning the brackets to the first position responsive to displacement of said brackets from said first position.

31. The system of claim 28, wherein the chains are positioned such that the pins reside in alignment with at least one of the brackets.

32. The system of claim 31, wherein the chains are positioned such that the pins reside in vertical alignment with at least one of the brackets.

33. A parking garage elevator system for storing vehicles, said system comprising:

a plurality of platforms for storing a plurality of vehicles thereon;

support means for supporting said platforms in two separate arrays; and a single-drive mechanism for imparting movement to the first and second arrays of platforms simultaneously to thereby advance any selected platform to a loading or unloading position;

wherein the single-drive mechanism further comprises a vertical movement means, said vertical movement means comprising a plurality of endless chains disposed in meshing engagement with a plurality of gear members, respectively;

wherein the chains each include lifting means for lifting an object;

wherein the lifting means comprises a plurality of pins extending outwardly from links of the chains; and wherein the vertical movement means further comprises a set of four endless chains comprising a first, second, third and fourth endless chain each extending in an upward direction, each endless chain being disposed in meshing engagement with at least two opposing gear members, wherein the first and second endless chains reside on a first side of the platforms and the third and fourth endless chains reside on a second side of the platforms, said chains being positioned such that some of the pins reside in contact with a portion of the platforms.

34. The system of claim 33, wherein each platform includes a plurality brackets extending outwardly from sides of the platform.

35. The system of claim 34, wherein at least some the brackets are rotatably disposed on the sides of the platforms.

36. The system of claim 35, wherein the brackets are rotatably disposed in a first position, further comprising:

return-action means for returning the brackets to the first position responsive to displacement of said brackets from said first position.

37. The system of claim 34, wherein the chains are positioned such that the pins reside in alignment with at least one of the brackets.

38. The system of claim 37, wherein the chains are positioned such that the pins reside in vertical alignment with at least one of the brackets.

39. A parking garage elevator system for storing vehicles, said system comprising:

a plurality of platforms for storing said vehicles;

first and second storage towers, wherein at least two platforms reside within each of said towers, wherein said platforms are horizontally stacked one above the other to thereby define a vertical space therebetween for storing a vehicle, each tower having at least two storage levels including an upper level and a lower level, wherein at least two platforms reside adjacent to each other at some point along the circulation path; and a moving means for moving said platforms along horizontal and vertical movement paths, and comprising a plurality of swing arms attached to the moving means by a hinge such that the swing arms may move from a first, open position into a second, fitted position, wherein the swing arms may attach to a portion of each of the platforms as the swing arms move from the first, open position to the second, fitted position to effectuate horizontal movement of said platforms.

40. The system of claim 39, wherein the moving means further comprises a vertical movement means and a horizontal movement means.

41. The system of claim 40, wherein the moving means comprises a means for providing unidirectional movement to said platforms without a reversal in movement direction.

42. The system of claim 41, wherein the moving means comprises a means for providing unidirectional movement to said platforms, and a reversing means for reversing a movement direction of said platforms.

43. The system of claim 40, wherein the vertical movement means comprises a system of chains and sprockets.

44. The system of claim 40 wherein the horizontal movement means comprises a conveyer system.

45. The system of claim 40 wherein the horizontal movement means comprises a lifting mechanism.

46. The system of claim 39, wherein the moving means further comprises movement means for moving platforms within the first storage tower in an upward direction while moving platforms within the second storage tower in a downward direction.

47. The system of claim 39, wherein the moving means comprises a lateral movement means for moving the platforms in a lateral direction, said lateral movement means comprising a lateral transfer system of idlers, chains and sprockets.

48. The system of claim 39, wherein the moving means further comprises a vertical movement means, said vertical movement means comprising a plurality of endless chains disposed in meshing engagement with a plurality of gear members, respectively.

49. The system of claim 48, wherein the chains each include lifting means for lifting an object.

50. The system of claim 49, wherein the lifting means comprises a plurality of pins extending outwardly from links of the chains.

51. A parking garage elevator system for storing vehicles, said system comprising:

a plurality of platforms for storing a plurality of vehicles thereon; and circulation means for moving the platforms along an endless circulation path having un upward-movement portion and a downward-movement portion to thereby cause the platforms to move in sequence along said path, such that each platform passes through a first position along said circulation path;

wherein the platforms are preferably arranged in first and second storage towers, wherein at least two platforms reside within each of said towers, wherein said platforms are horizontally stacked one above the other to thereby define a vertical space therebetween for storing a vehicle, each tower having at least two storage levels including an upper level and a lower level, wherein at least two platforms reside adjacent to each other at some point along the circulation path;

wherein the circulation means comprises a vertical movement means and a horizontal movement means;

wherein the circulation means further comprises movement means for imparting alternating vertical and horizontal movement to at least some of the platforms;

wherein the movement means comprises, a means for providing unidirectional movement to said platforms without a reversal in movement direction;

wherein the vertical movement means comprises a system of chains and sprockets;

wherein the circulation means further comprises movement means for moving platforms within the first storage tower in an upward direction while moving platforms within the second storage tower in a downward direction;

wherein the horizontal movement means comprises a conveyer system;

wherein the circulation means further comprises a vertical movement means, said vertical movement means comprising a plurality of endless chains disposed in meshing engagement with a plurality of gear members, respectively;

wherein the chains each include lifting means for lifting an object;

wherein the lifting means comprises a plurality of pins extending outwardly from links of the chains;

wherein the vertical movement means further comprises a set of four endless chains comprising a first, second, third and fourth endless chain each extending in an upward direction, each endless chain being disposed in meshing engagement with at least two opposing gear members, wherein the first and second endless chains reside on a first side of the platforms and the third and fourth endless chains reside on a second side of the platforms, said chains being positioned such that some of the pins reside in contact with a portion of the platforms;

wherein each platform includes a plurality brackets extending outwardly from sides of the platform;

wherein at least some the brackets are rotatably disposed on the sides of the platforms;

wherein the chains are positioned such that the pins reside in alignment with at least one of the brackets;

wherein the brackets are rotatably disposed in a first position, further comprising:

return-action means for returning the brackets to the first position responsive to displacement of said brackets from said first position;

wherein the lateral movement means comprises positioning means for moving the lateral transfer system from an idle position to a transfer position residing beneath a platform.

52. An elevator system for storing objects, said system comprising:

a plurality of platforms for storing a plurality of objects thereon; and circulation means for moving the platforms along an endless circulation path having un upward-movement portion and a downward-movement portion to thereby cause the platforms to move in sequence along said path, such that each platform passes through a first position along said circulation path;

wherein the circulation means further comprises a plurality of chains, wherein each of the plurality of chains comprises a plurality of cantilevered pins extending orthogonal to a direction of movement of said chains and outwardly therefrom, respectively, and into engagement with the platforms or a member directly attached to said platforms to thereby lift said platforms responsive to upward movement of the circulation means.

53. A parking garage elevator system for storing vehicles, said system comprising:

a plurality of platforms for storing a plurality of vehicles thereon; and circulation means for moving the platforms along an endless circulation path having an upward-movement portion and a downward-movement portion to thereby cause the platforms to move in sequence along said path, such that each platform passes through a first position along said circulation path;

lateral movement means for moving one of the plurality of platforms in a lateral direction from a first position to a second position;

a plurality of swing arms attached to the lateral movement means by a hinge such that the swing arms may move from a first, open position into a second, fitted position wherein the swing arms attach to a portion of each of the platforms as the swing arms move from the first, open position to the second, fitted position to effectuate lateral movement of said platforms.

54. A parking garage elevator system for storing vehicles, said system comprising:

a plurality of platforms for storing a plurality of vehicles thereon, each of the platforms comprising a planar surface for receiving at least one of the plurality of vehicles thereon, wherein each of the platforms further comprises side surfaces;

circulation means for moving the platforms along an endless circulation path having an upward-movement portion and a downward-movement portion to thereby cause the platforms to move in sequence along said path, such that each platform passes through a first position along said circulation path; and a plurality of brackets extending outwardly from the side surfaces of each of the platforms and into engagement with a portion of the circulation means to thereby enable said circulation means to lift said platforms responsive to upward movement of the circulation means;

wherein the circulation means further comprises a plurality of chains, wherein each of the plurality of chains comprises a plurality of cantilevered pins extending orthogonal to a direction of movement of said chains and outwardly therefrom, respectively, and into engagement with at least one of the brackets extending from the platforms to thereby lift said platforms responsive to upward movement of the circulation means.

55. A parking garage elevator system for storing vehicles, said system comprising:

a plurality of platforms for storing a plurality of vehicles thereon;

circulation means for moving the platforms along an endless circulation path having an upward-movement portion and a downward-movement portion to thereby cause the platforms to move in sequence along said path, such that each platform passes through a first position along said circulation path, wherein the circulation means further comprises a plurality of chains, and wherein each of the plurality of chains comprises a plurality of cantilevered pins extending orthogonal to a direction of movement of said chains and outwardly therefrom; and access means for providing access to multiple platforms simultaneously to permit entry to or exit from at least two platforms simultaneously by at least two vehicles, respectively.

* * * * *